US006250492B1

(12) United States Patent
Verbeek

(10) Patent No.: US 6,250,492 B1
(45) Date of Patent: Jun. 26, 2001

(54) DEVICE FOR SUPPORTING A LID IN AN APPROXIMATELY VERTICAL POSITION

(75) Inventor: Antonius Johannes Verbeek, Valkenswaard (NL)

(73) Assignee: Brabantia Nederland B.V., Waalre (NL)

( * ) Notice: Subject to any disclaimer, the term of this patent is extended or adjusted under 35 U.S.C. 154(b) by 0 days.

(21) Appl. No.: 09/554,321

(22) PCT Filed: Nov. 11, 1998

(86) PCT No.: PCT/NL98/00653

§ 371 Date: Jul. 24, 2000

§ 102(e) Date: Jul. 24, 2000

(87) PCT Pub. No.: WO99/24332

PCT Pub. Date: May 20, 1999

(30) Foreign Application Priority Data

Nov. 12, 1997 (NL) ..... 1007522

(51) Int. Cl.[7] ..... B65D 43/00

(52) U.S. Cl. ..... 220/495.11; 220/495.08; 220/908

(58) Field of Search ..... 220/495.08, 495.11, 220/908

(56) References Cited

U.S. PATENT DOCUMENTS

| | | | | |
|---|---|---|---|---|
| 3,860,141 | | 1/1975 | Hawk . | |
| 4,444,355 | * | 4/1984 | Cary | 220/495.11 |
| 4,753,367 | * | 6/1988 | Miller et al. | 220/495.11 |
| 4,765,579 | * | 8/1988 | Robbin, III et al. | 220/495.11 |
| 5,341,952 | * | 8/1994 | Goglio | 220/495.08 |
| 5,385,259 | * | 1/1995 | Bernstein et al. | 220/495.11 |
| 5,632,401 | | 5/1997 | Hurd . | |
| 5,653,680 | * | 8/1997 | Asbach et al. | 220/495.11 |

FOREIGN PATENT DOCUMENTS

| | | |
|---|---|---|
| 330 523 | 6/1930 | (GB) . |
| 1 470 974 | 4/1977 | (GB) . |

* cited by examiner

*Primary Examiner*—Joseph M. Moy
(74) *Attorney, Agent, or Firm*—Young & Thompson

(57) ABSTRACT

Combination of an edge retainer (5), which can be placed separately over the top edge of a rubbish bag (3) supported by an annular support (1), with an associated lid (7) which can be removed in its entirety from the edge retainer and can be placed in a closing position thereon. The edge retainer has supporting parts (25, 27, 33) at the top, by means of which it is possible to place a rim section of the lid in an approximately vertical position on the edge retainer. The lid can have a circular lid rim (19) and the supporting parts which serve to support the lid in the said approximately vertical position are adapted to support an arbitary section of the lid rim, so that, in respect of the periphery, the lid can be placed in an arbitrary position on the edge retainer. As an embodiment, the edge retainer can have been provided with a seating (31), delimited by walls, for a rim section of the lid.

1 Claim, 3 Drawing Sheets

DEVICE FOR SUPPORTING A LID IN AN APPROXIMATELY VERTICAL POSITION

The invention relates to a container having an an annular support at its upper edge, an edge retainer, which can be placed separately over the top edge of a rubbish bag supported on said annular support of said container, and an associated lid having a circumferential rim which lid can be removed in its entirety from the edge retainer and which can be placed thereon in a position in which the container is closed.

A container of this type is disclosed in U.S. Pat. No. 5,632,401. With such an arrangement the rubbish bag can be fitted over an annular support which is formed by the top edge of a dimensionally stable waste bin or basket or over a sturdy metal ring which, at one side, is itself supported by a wall, a column or something similar. Combinations of this type are well known in practice, the edge retainer fulfilling a multiple function. Firstly, the top edge of the rubbish bag is clamped firmly on the annular support. In this way the rubbish bag is prevented from blowing away or slipping down under the effect of waste present therein, etc. Secondly, the edge retainer acts as a support for a lid placed thereon. In this context use is made of the fact that the edge retainer forms a stable and suitably sized component that in terms of dimensions and shape is intended to interact with a specific type of lid. Finally, the edge retainer also serves to hide the rubbish bag when the latter is fitted around the top edge of the waste bin. The present invention has to do with combinations of this type with which the lid can be removed in its entirety from the edge retainer. The edge retainer and the lid are, however, matched to one another and in general are supplied together.

One problem with the known combinations of this type is that a user who wishes to deposit waste in the rubbish bag has, after opening the lid, either to hold the lid by one hand, so that only the other hand is available for depositing the waste in the rubbish bag, or has to put the lid down somewhere in the vicinity. Both alternatives are frequently found not to be ideal and are regarded as a disadvantage of this type of simple combinations of edge retainer and separate lid.

The aim of the invention is to avoid this disadvantage.

Therefore the container is characterised in that the edge retainer comprises a seating section having a horizontal base and two upstanding walls delimiting said base at two opposite positions, wherein in a stable substantial vertical position of the lid said rim rests on said base and parts of said upstanding walls act to support the lid in said substantially vertical position.

The user can place the lid in an approximately vertical position on the edge retainer and leave it in this position in order then to be able to deposit waste in the rubbish bag, optionally making use of two hands. The lid can then be returned to the closing position. When used with a rubbish bag, the container with edge retainer and lid according to the invention has at least approximately the same functionality as in the case of waste bins where the lid is hinged and can be opened by means of a foot pedal. Essentially the functionality is even somewhat greater because in the case of such foot-operated waste bins the lid will frequently drop back down as soon as the foot is taken away from the pedal, so that it is necessary to keep the foot on the pedal while depositing waste in the rubbish bag. The lid does not have to be provided with special edge portions but can be placed in an approximately vertical position on the edge retainer on any desired part of the lid rim.

The seating delimited by walls is easy to produce in an injection moulding mould or in an vacuum forming mould for the production of plastic edge retainers and technically gives rise to few problems.

GB-A-330523 discloses a dust bin having a lid or cover provided with a tongue. This tongue has an inwardly turned end piece to engage the upper rim of the bin to hold the lid in a vertical position without preventing the lid being completely removed from the bin when required. The lid does not have a radially protuding rim and there is no talk of an edge retainer comprising a seating section having a horizontal base and two wall sections.

U.S. Pat. No. 3,860,141 relates to a container with a self-hinging cover not requiring a hinge mechanism that fixedly interconnects the cover in hinged relationship to the container. The cover is formed with a hinging structure that detachably engages the upper peripheral rim of the container. The cover has two hinge flanges each comprising a hinge notch configured to receive the container's peripheral rim with the upper edge portion of the notch being alternately curved to facilitate pivotal movement of the cover on the container. By displacing the cover to an open vertical direction a surface of a flange of the cover engages a circumferential rim of the container. This known construction does not have a separate edge retainer comprising a seating section having a horizontal base and two wall sections on which seating section the lid can take a stable vertical position.

GB-A-1470974 relates to a removable lid for a container which is provided with a hinge element which allows removal of the lid as well as pivotal movement. Also this construction does not have a separate edge retainer to be placed over the top of a rubber bag supported by an annular support of the container.

The invention will now be explained exclusively by way of non-limiting example with reference to the drawing, in which.

In the various Figures the same reference numerals are used for the same components.

Figure 1:
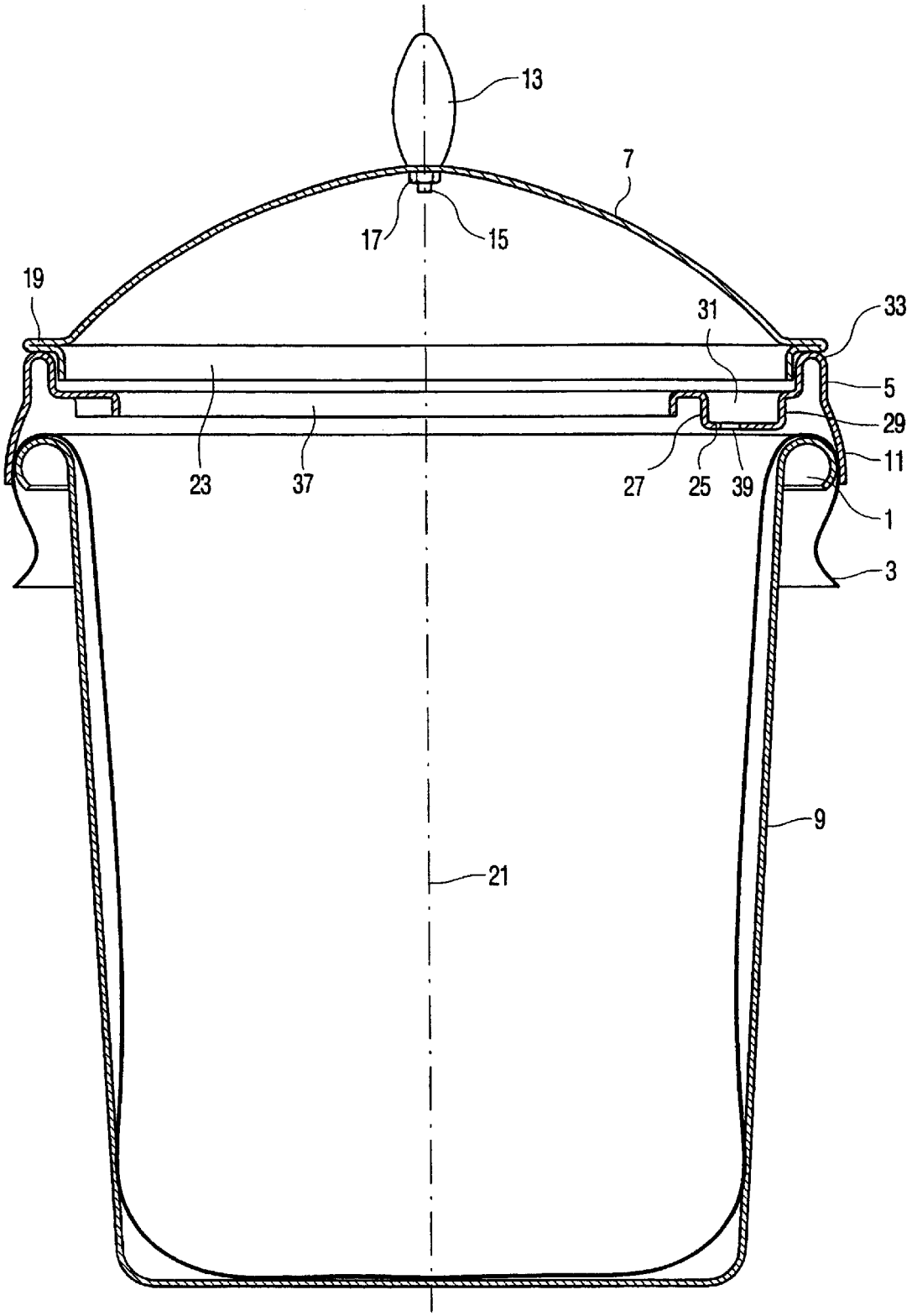
FIG. 1 is a cross-section through the axis of a waste bin provided with a rubbish bag fitted over the edge and with a combination according to the invention.

FIG. 1 shows a combination of an edge retainer 5, which can be placed separately over the top edge of a rubbish bag 3 supported by an annular support 1, and an associated lid 7 which can be removed in its entirety from the edge retainer 5 and is placed thereon in a closing position. The annular support is formed by the annular top edge of a bin-shaped waste bin 9 which is made of plastic and has a height and shape such that it is suitable for interaction with the rubbish bag 3 and has a height which is somewhat shorter than the length of the rubbish bag 3, so that the latter can be fitted close to the top edge over the annular support 1. The edge retainer 5 has been produced in one piece from an elastic plastic and has been adapted to the annular support 1 of the waste bin 9 such that on fitting as is shown in FIG. 1 that part of the rubbish bag 3 which is folded over the support 1 is clamped between the annular support and the inside wall of a surrounding annular wall 11 of the edge retainer.

The lid 7 is made of metal and in general is in the shape of part of a sphere. If desired, a lid made of a suitable plastic can also be used. For the purposes of manipulating the lid, a, for example wooden, handle 13 is fitted on the top of the lid with the aid of a threaded pin 15 which extends through an opening at the top of the lid and a retaining nut 17. With the aid of a folding operation, the lid is provided at the periphery with a flat annular rim 19 and a cylindrical apron 23 which extends downwards from said rim 19 and is coaxial with the axis 21 of the waste bin and of the edge retainer fitted thereon. With the aid of the rim 19, the lid bears on the top of the edge retainer 5 and with the aid of the apron 23 the lid is secured, with play, against horizontal shifting within the edge retainer 5.

Figure 5:
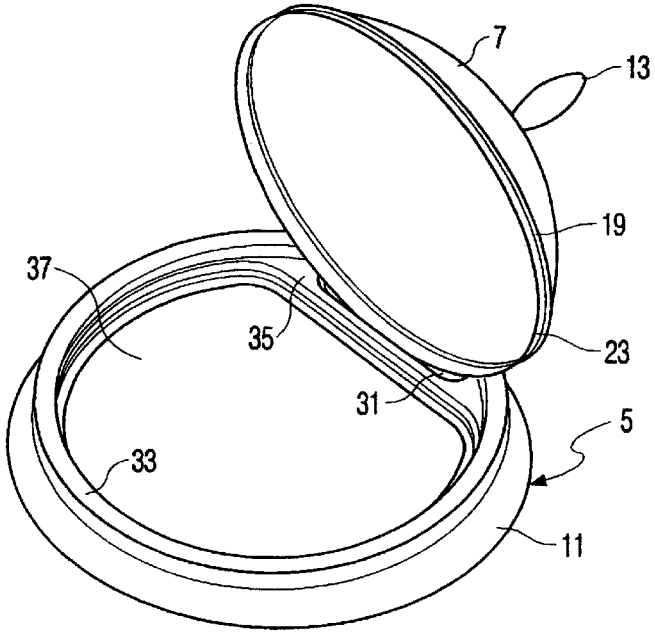
FIG. 5 is a perspective view of the edge retainer according to FIGS. 2 and 3 as used with the waste bin according to FIG. 1, the lid being placed in an approximately vertical position on the edge retainer.
Figure 6:
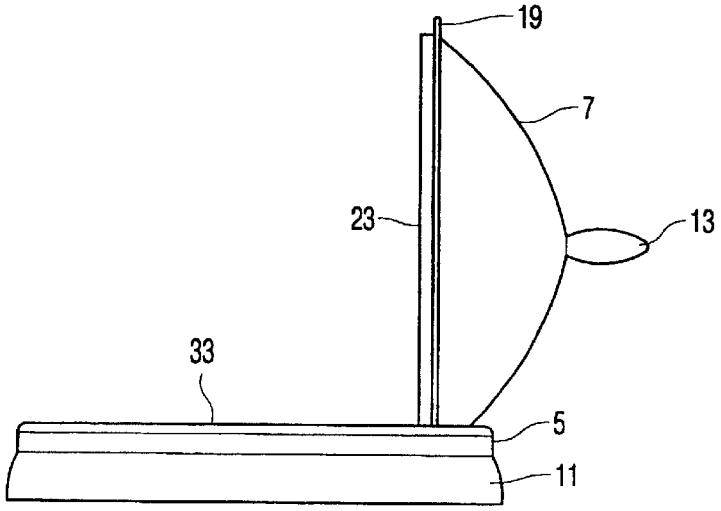
FIG. 6 is a side view of the combination of edge retainer and lid from FIG. 5.

It will be clear from the above that, for example by grasping the handle 13, the lid 7 can be removed in its entirety from the edge retainer 5 and can be replaced thereon in the closing position shown in FIG. 1. According to the invention the edge retainer 5 is provided at the top with supporting parts 25, 27 and 29 for supporting a rim section of the lid 7 in a position in which it is placed approximately vertically on the edge retainer 5. In the embodiment under consideration, the said supporting parts consist of the base 25 of a seating 31 provided at the top of the edge retainer, as well as of the wall sections 27 and 29 of the seating 31, which wall sections are located opposite one another; see, in particular, FIGS. 2 and 3. As a result of the presence of the said supporting parts, it is possible, in accordance with the invention, for the lid 7, see, in particular, FIGS. 5 and 6, to be placed in an approximately vertical position on the edge retainer 5, specifically with an arbitrary part of the rim 19 and the apron 23 of the lid placed in the seating 31. See, in particular, FIG. 2, where part of the lid in the vertical position is shown by a broken line. The wall sections of the edge retainer which serve as supporting parts in the embodiment shown are the base 25 of the seating, the wall 27 of the seating and a point or a section of the top rim 33 of the edge retainer 5.

Figure 2:
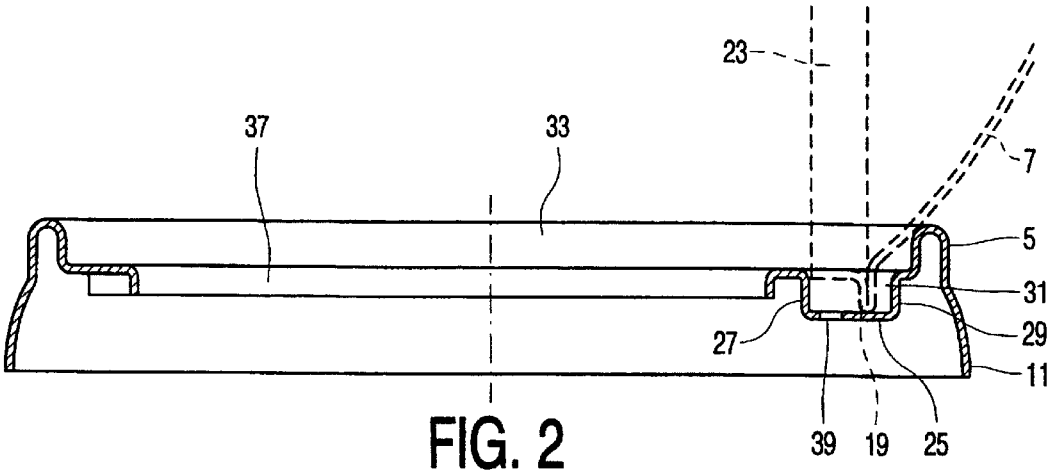
FIG. 2 is a cross-sectional view of the edge retainer used in the combination in FIG. 1.
Figure 3:
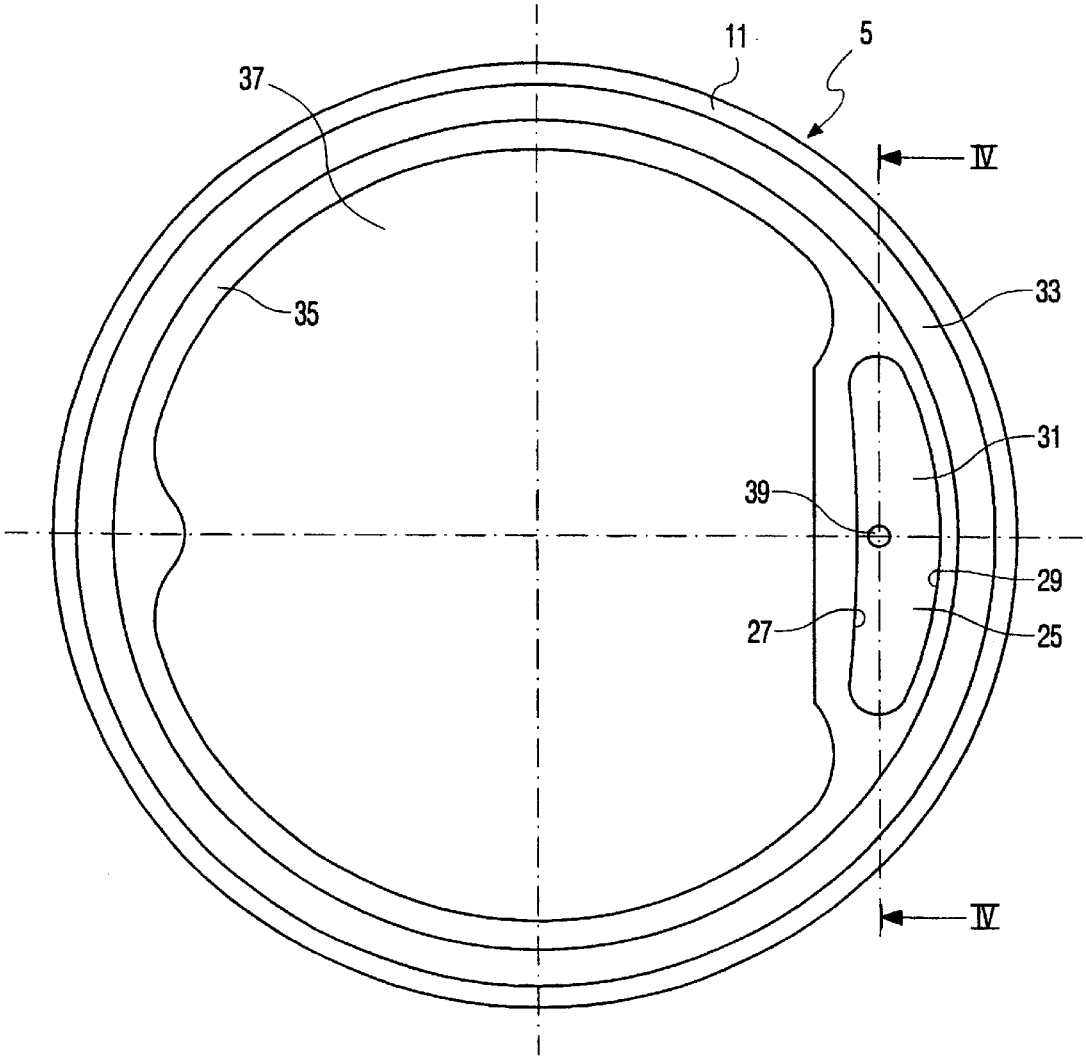
FIG. 3 is a top view of the edge retainer according to FIG. 2.
Figure 4:
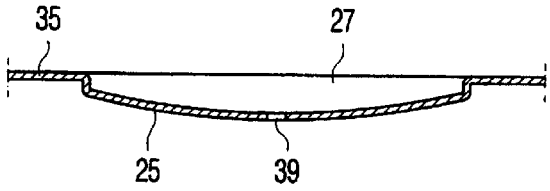
FIG. 4 is a cross-section along the line IV—IV in FIG. 3.

As follows from the figures, in particular FIGS. 2 and 3, the supporting parts, 25, 27 and 33 have been adapted to support an arbitrary section of the circular rim 19 of the lid.

In the embodiment shown, the seating 31 has been constructed as a local depression in a horizontal plane 35, which extends from the inner margin of the rim 33 of the edge retainer and delimits a central opening 37 which defines an access opening to the interior of the waste bin 9, the periphery of which is located further towards the inside with respect to the top edge 1 of the waste bin 9.

It will be clear from the above that the lid 7 can be placed in an approximately vertical position on the edge retainer 5 at an arbitrary point on the periphery, the weight of the lid being borne by the supporting part 25 which is formed by the base of the seating 31, the side wall 29 of the seating 31 and part of the top rim 33 of the edge retainer 5. By this means an edge retainer, covered by a lid, for waste bins or rubbish bags or the like which has improved functionality and improved ease of use is produced by technically simple means.

Although the invention has been explained with reference to a single illustrative embodiment, the invention is in no way restricted thereto. In order to support the lid in an approximately vertical position it is necessary for supporting means to be present which, on the one hand,. take the weight of the lid and, furthermore, exert essentially horizontal forces on either side of the lid, at either side of the point where the weight acts on the edge retainer, in order to produce a force couple which prevents the lid from falling over. In addition to wall sections, such supporting means can, thus, also consist of, for example, pins, ridges, corrugations, bridges, etc. which are able to produce the requisite forces. When a seating as shown in the figures is used, the seating can, if desired, be provided at the lowest point with an opening for discharging water, dust or dirt particles. An opening of this type is shown in the figures and is indicated by the reference numeral 39.

What is claimed is:

1. Container having an an annular support (1) at its upper edge, an edge retainer (5), which can be placed separately over the top edge of a rubbish bag (3) supported on said annular support (1) of said container (9), and an associated lid (7) having a circumferential rim (17) which lid can be removed in its entirety from the edge retainer (5) and which can be placed thereon in a position in which the container is closed, characterised in that the edge retainer (5) comprises a seating section (31) having a horizontal base (25) and two upstanding walls (27, 29) delimiting said base (25) at two opposite positions, wherein in a stable substantial vertical position of the lid (7) the rim (17) rests on said base (25) and parts (27, 31) of said upstanding walls act to support the lid (7) in said substantially vertical position.

* * * * *